United States Patent [19]

Kenney

[11] Patent Number: 4,624,147

[45] Date of Patent: Nov. 25, 1986

[54] PIPET GUN FOR DRAWING LIQUID INTO AND EXPELLING IT FROM A PIPET

[75] Inventor: James W. Kenney, West Chester, Pa.

[73] Assignee: Drummond Scientific Company, Broomall, Pa.

[21] Appl. No.: 797,217

[22] Filed: Nov. 12, 1985

[51] Int. Cl.[4] ..... B01L 3/02

[52] U.S. Cl. ..... 73/864.15

[58] Field of Search ..... 73/864.01, 864.11, 864.14, 73/864.15

[56] References Cited

U.S. PATENT DOCUMENTS 3,834,240 9/1974 Kenney ..... 73/864.15

3,963,061 6/1976 Kenney ..... 73/864.15

*Primary Examiner*—Stewart J. Levy

*Assistant Examiner*—Robert R. Raevis

*Attorney, Agent, or Firm*—John F. A. Earley; John F. A. Earley, III

[57] ABSTRACT

A pipet gun for drawing liquid into and expelling it from a pipet comprises a housing which includes a hand grip portion and a barrel portion with a pipet-supporting portion connected to the barrel portion, conduits in the housing adapted to connect an air pressure source and a vacuum source to the pipet-supporting portion, valves carried by the hand grip portion in operative engagement with the conduit and operable to selectively establish, and cut off, communication between the pipet-supporting portion, air pressure source, and vacuum source. The valves include a molded plastic valve body with a molded plastic back portion connected to a molded plastic front portion with a gasket positioned therebetween, and the necessity of precision drilling of long bores is eliminated.

5 Claims, 13 Drawing Figures

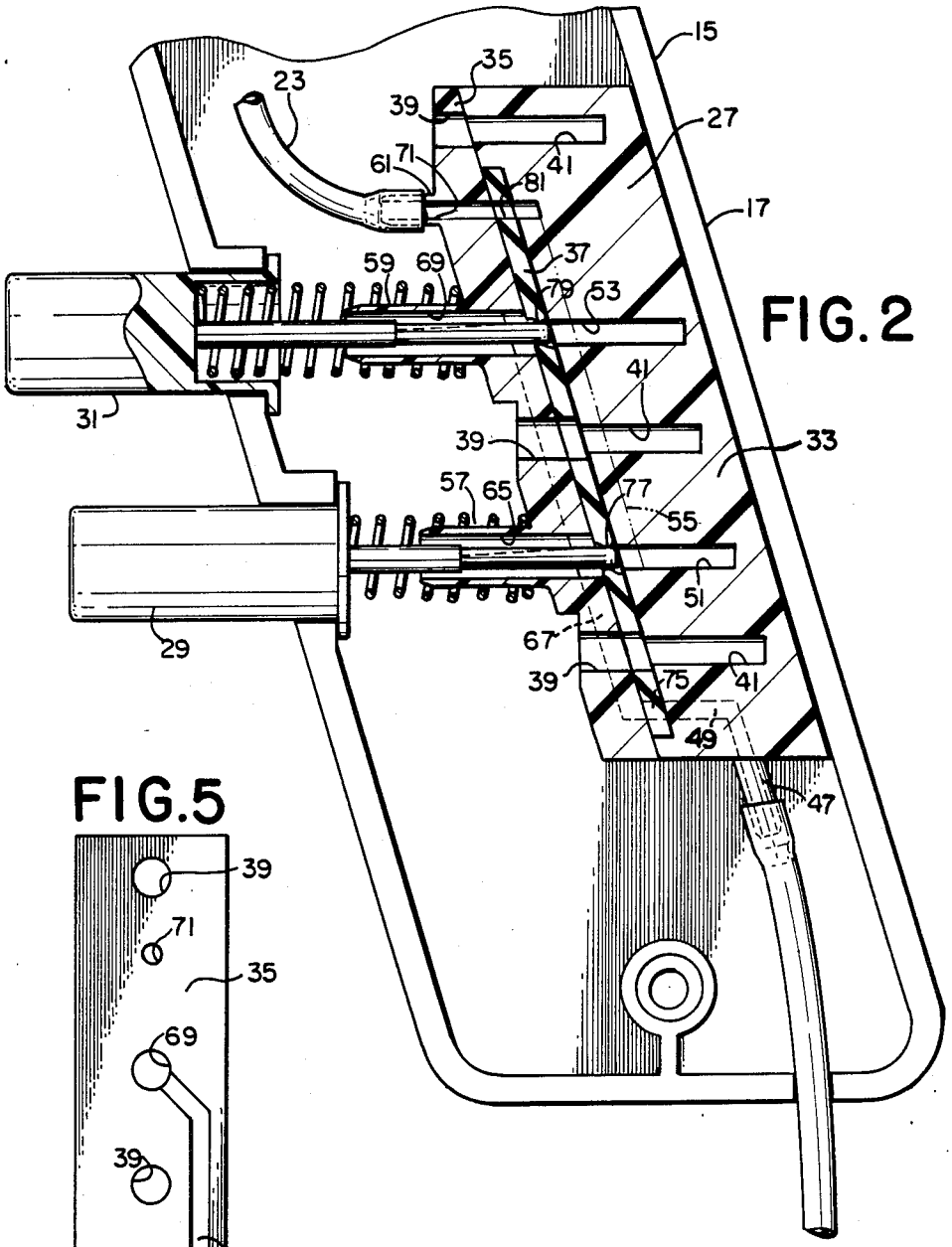
FIG. 2
FIG. 5
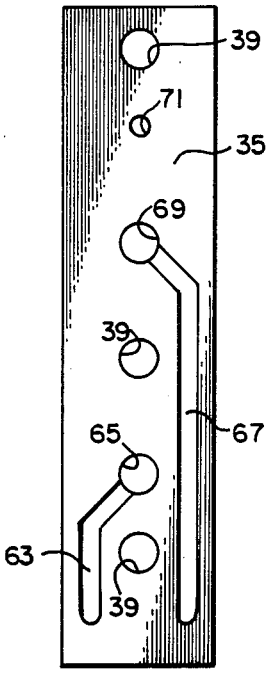

PIPET GUN FOR DRAWING LIQUID INTO AND EXPELLING IT FROM A PIPET

BACKGROUND OF THE INVENTION

1. Technical Field

This invention is in the field of liquid handling devices, and more specifically is in the field of pipet guns for drawing liquid into and expelling liquid from a pipet.

2. Related Inventions

This invention is related to the inventions shown in U.S. Pat. Nos. 3,963,061; 3,834,240; and U.S. Pat. No. Des. 242,729, all of which are owned by Drummond Scientific Company, Broomall, Pa. and all of which are incorporated herein by reference.

3. Background of the Prior Art

The present pipet gun is an improvement over those shown in my previously granted U.S. Pat. No. 3,963,061 of June 15, 1976, U.S. Pat. No. 3,834,240 of Sept. 10, 1974, and U.S. Pat. No. Des. 242,729 granted Dec. 14, 1976.

As pointed out in previous patents, the practice of mouth pipetting liquid samples can be harmful, and the practice has been prohibited in many laboratories. Mechanical devices have been developed in an attempt to replace mouth pipetting, but many of these devices are cumbersome to operate and can cause operator fatigue.

My previous pipet guns have been commercially successful, and the present invention is an improvement. It is particularly directed to a pipet gun having an improved valve body which is less expensive to manufacture.

BRIEF SUMMARY OF THE INVENTION

The present invention is directed to a pipet gun having a housing including a hand grip portion and a barrel portion, a pipet-supporting portion connected to the barrel portion, conduit means in the housing adapted to connect an air pressure source and a vacuum source to the pipet-supporting portion, and valve means for selectively connecting the air pressure source and the vacuum source to the pipet-supporting portion, with said valve means including a valve body with a molded plastic back portion and a molded plastic front portion, a gasket positioned between the front and back portions of the valve body, with the valve body back portion having an output channel molded in its front face for connecting air or vacuum to the conduit means connecting with the pipet-supporting portion, and the valve body front portion having an air input channel molded into the back face and adapted to conduct air to the bore of an air valve post, and a vacuum channel formed in its back face for conducting a vacuum to the bore of the vacuum valve post. The gasket has a seal bead contoured to contact the front face of the valve body back portion and surround the output channel.

BRIEF DESCRIPTION OF THE DRAWINGS

FIG. 2 is an enlarged view in section showing the valve body of the pipet gun constructed in accordance with this invention;

FIG. 5 is a view of the back face of the front portion of the valve body shown in FIG. 3;

DETAILED DESCRIPTION

Figure 1:
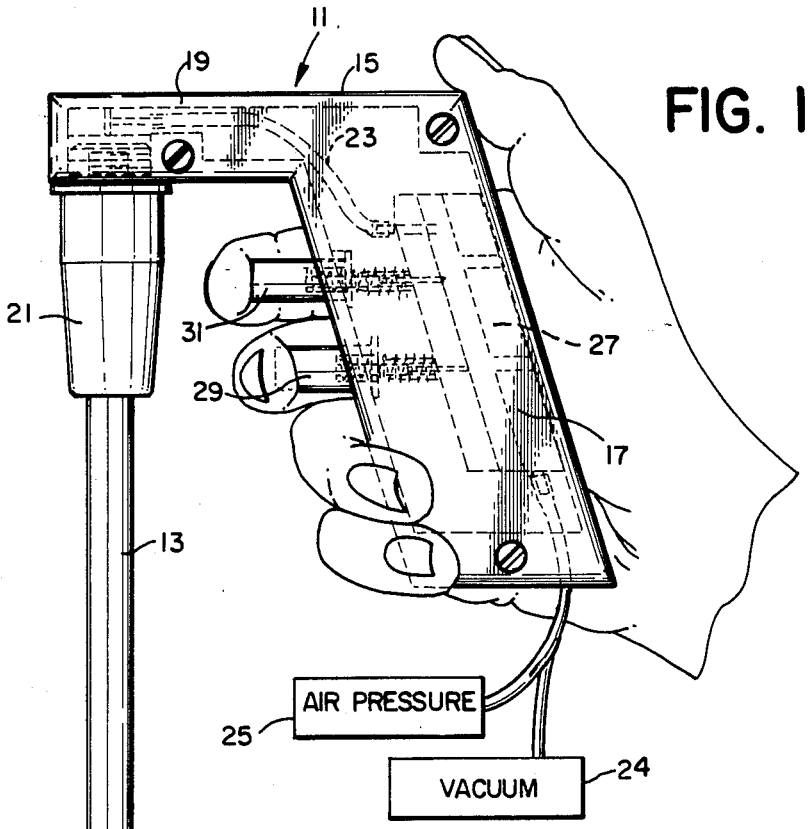
FIG. 1 is a view in side elevation of a pipet gun constructed in accordance with this invention.
Figure 3:
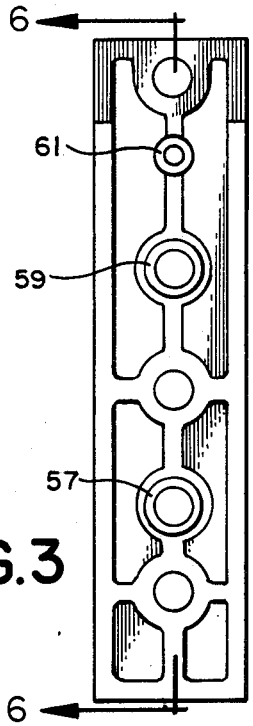
FIG. 3 is a view in front elevation of the front portion of the valve body.
Figure 4:
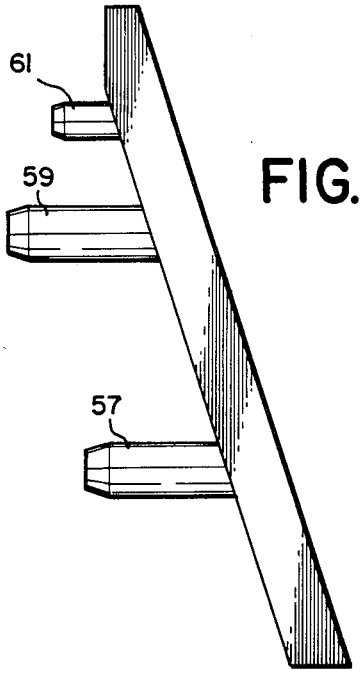
FIG. 4 is a view in side elevation of the front portion of the valve body shown in FIG. 3.
Figure 6:
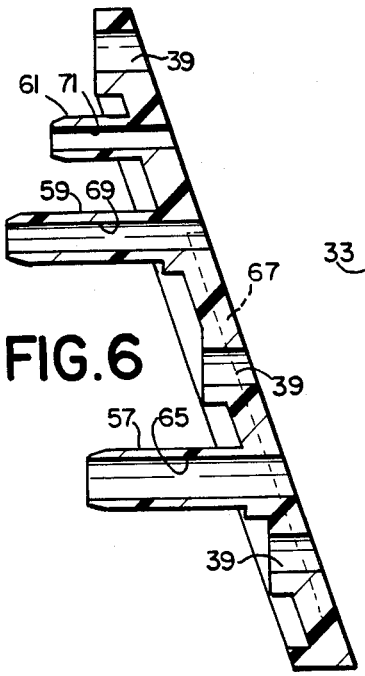
FIG. 6 is a view in section taken as indicated by the lines and arrows 6—6 which appear in FIG. 3.
Figure 7:
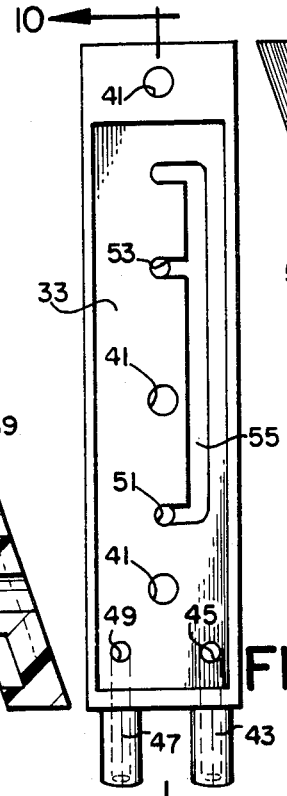
FIG. 7 is a view of the front face of the back portion of the valve body.
Figure 8:
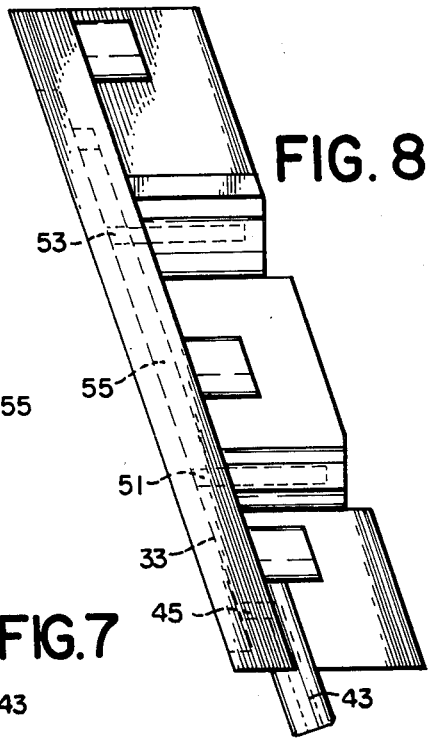
FIG. 8 is a view in side elevation of the back portion of the valve body.
Figure 9:
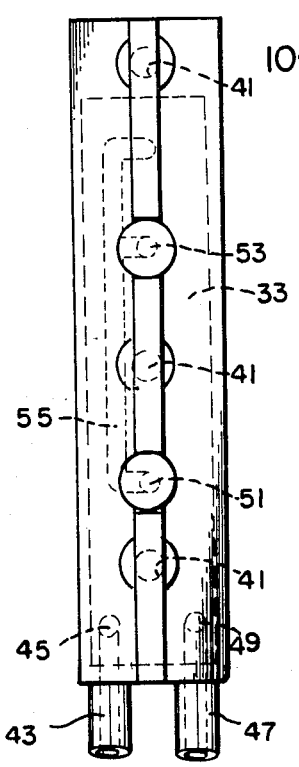
FIG. 9 is a view in elevation of the back face of the back portion of the valve body.
Figure 10:
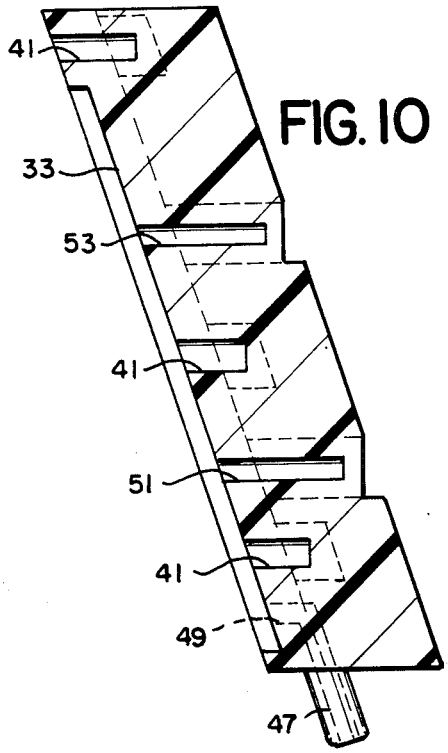
FIG. 10 is a view in section taken as indicated by the lines and arrows 10—10 which appear in FIG. 7.

Turning to the drawings, there is shown a pipet gun 11 for drawing liquid into and expelling it from a pipet 13, which comprises a housing 15 that includes a hand grip portion 17 and a barrel portion 19. A pipet-supporting portion 21 is connected to barrel portion 19 and is adapted to hold pipet 13 in a manner which is shown and described in my U.S. Pat. No. 3,963,061.

A hose 23 is connected from the pipet-supporting portion 21 to a vacuum source 24 and an air pressure source 25 by a valve body 27 which includes conduit means that connect the air and vacuum to the hose 23, with the air and vacuum being controlled by air valve 29 and vacuum valve 31.

Valve body 27 includes a molded plastic back portion 33 and a molded plastic front portion 35, with a gasket 37 positioned between them. The back and front portions 33, 35 and the gasket 37 are connected together by screws which extend through screw holes 39 in front portion 35 and screw holes 41 in back portion 33.

An air inlet pipe 43 extends from the bottom of valve body back portion 33 and is connected to a conduit or passageway 45 which extends toward valve body front portion 35. A vacuum inlet pipe 47 extends from the bottom of valve body back portion 33 and is connected to a conduit or passageway 49 that extends toward the valve body front portion 35.

Valve stem recesses 51, 53 are also molded into valve body back portion 33 with recess 51 being adapted to receive the stem of air valve 29, and recess 53 being adapted to receive the stem of vacuum valve 31.

An output channel 55 is molded in the front face of the valve body back portion 33 for connecting air or vacuum from the valves 29, 31 to the hose 23 and the pipet-supporting portion 21.

The valve body front portion 35 is provided with an air valve post 57, a vacuum valve post 59, and a hose connector post 61, with all the posts extending horizontally from the front face of valve body front portion 35.

An air input channel 63, FIG. 5, is molded in the rear face of valve body front portion 35 and is adapted to conduct input air from air inlet pipe 43 and passageway 45 to the bore 65 of air valve post 57.

A vacuum input channel 67 is formed in the rear face of valve body front portion 35 and is adapted to conduct vacuum to the bore 69 of vacuum valve post 59 from vacuum inlet pipe 47 and passageway 49 in valve body back portion 33.

Hose connector post 61 is provided with a bore 71 adapted to conduct air or vacuum to the hose 23 that extends to the pipet-supporting portion 21.

Figure 11:
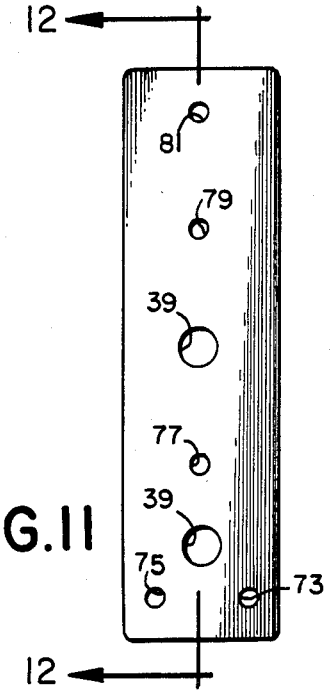
FIG. 11 is a view in front elevation of a gasket that is positioned between the front and back portions of the valve body.
Figure 12:
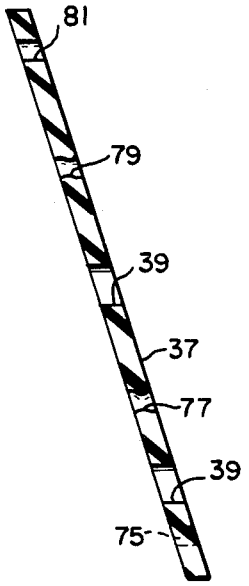
FIG. 12 is a view in section of the gasket taken as indicated by the lines and arrows 12—12 which appear in FIG. 11.
Figure 13:
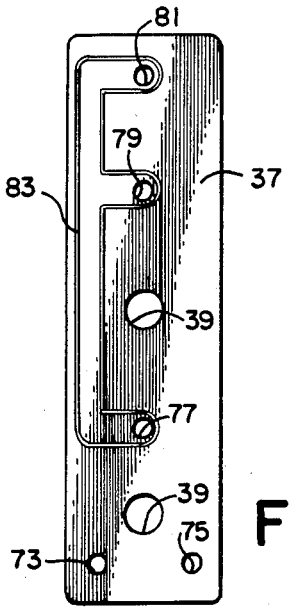
FIG. 13 is a view in elevation of the back face of the gasket.

Gasket 37, FIGS. 11–13, is made of a resilient material, such as rubber, and is provided with an air conduit or passageway 73 that connects air inlet pipe 43 and passageway 45 to air input channel 63 in valve body front portion 35. Gasket 37 is also provided with a vacuum conduit or passageway 75 that connects vacuum inlet pipe 47 and conduit 49 to vacuum input channel 67 in valve body front portion 35.

Air outlet hole 77 connects bore 65 of air valve post 57 to output channel 55, vacuum outlet hole 79 connects bore 69 of vacuum valve post 59 to outlet channel 55, and hole 81 connects output channel 55 to bore 71 of hose connector post 61.

A seal bead 83 is contoured to surround the shape of the output channel 55 and is adapted to contact the front face of the valve body back portion 33 and surround the output channel 55 to seal the output channel.

In operation, the end of pipet 13 is placed in the liquid to be drawn into the pipet, and the operator presses vacuum valve 31 so that the vacuum passes from vacuum source 24 to vacuum inlet pipe 47, conduit 49, gasket passageway 75, vacuum input channel 67, bore 69 of vacuum valve post 59, gasket vacuum outlet hole 79, output channel 55, gasket hole 81, bore 71 of hose connector post 61, hose 23, and pipet-supporting portion 21.

When the desired amount of liquid is drawn into pipet 13, the vacuum valve 31 is released and the pipet gun 11 is transported to the place where the liquid is to be discharged. Then air valve 29 is pressed by the operator, and air pressure from air pressure source 25 passes through air inlet pipe 43, passageway 45, gasket air passageway 73, air input channel 63. bore 65 of air valve post 57, gasket air outlet hole 77, output channel 55, gasket hole 81, bore 71 of hose connector 61, hose 23, and pipet-supporting portion 21 where the air pushes the liquid to discharge it from pipet 13.

Among the advantages of the new valve body 27 is that it is molded and does not require the precision drilling of long bores which is expensive. The new valve body 27 has only three parts and requires only three screws to assemble it, so assembly is easy.

I claim:

1. A pipet gun for drawing liquid into and expelling it from a pipet, comprising a housing including a hand grip portion and a barrel portion, a pipet-supporting portion connected to the barrel portion, conduit means in the housing adapted to connect an air pressure source and a vacuum source to the pipet-supporting portion, valve means carried by the hand grip portion in operative engagement with the conduit means and operable to selectively establish, and cut off, communication between the pipet-supporting portion, air pressure source, and vacuum source, said valve means including a valve body with a molded plastic back portion and a molded plastic front portion, a gasket positioned between the back and front portions, and means connecting together the back and front portions and the gasket, said valve body back portion having an output channel molded in the front face of the valve body back portion for connecting air or vacuum to the conduit means connecting with the pipet-supporting portion, said valve body front portion having an air valve post extending horizontally therefrom, a vacuum valve post extending horizontally therefrom, and a hose connector post extending horizontally therefrom to connect with a hose that extends to the pipet-supporting portion, an air input channel formed in the back of the valve body front portion and adapted to conduct air to the bore of the air valve post, and a vacuum input channel formed in the back of the valve body front portion and adapted to conduct vacuum to the bore of the vacuum valve post, said hose connector post having a bore adapted to conduct air or vacuum to the hose extending to the pipet-supporting portion.

2. The pipet gun of claim 1, including an air inlet pipe extending from the bottom of the valve body back portion and connected to a conduit extending toward the valve body front portion, and a vacuum inlet pipe extending from the bottom of the valve body back portion and connected to a conduit extending toward the valve body front portion.

3. The pipet gun of claim 2, said gasket being made of a resilient material and having a hole for passing inlet air from the valve body back portion air inlet pipe to the bore of the air valve post, a hole for passing vacuum from the body back portion vacuum inlet pipe to the bore of the vacuum valve post, a hole for passing air from the air valve post to the output channel, a hole for passing vacuum from the vacuum valve post to the output channel, and a seal bead contoured to contact the front face of the valve body back portion and surround the output channel.

4. The pipet gun of claim 1, said valve body back portion having an air inlet pipe extending from the bottom of the valve body back portion and adapted to be connected to a hose connected to the air pressure source, and a horizontal air conduit extending toward the front portion of the valve body, and a vacuum inlet pipe extending from the bottom of the valve body back portion and adapted to be connected to a hose connected to the vacuum source, and a horizontal vacuum conduit extending toward the front portion of the valve body.

5. A pipet gun for drawing liquid into and expelling it from a pipet, comprising a housing including a hand grip portion and a barrel portion, a pipet-supporting portion connected to the barrel portion, conduit means in the housing adapted to connect an air pressure source and a vacuum source to the pipet-supporting portion, valve means carried by the hand grip portion in operative engagement with the conduit means and operable to selectively establish, and cut off, communication between the pipet-supporting portion, air pressure source, and vacuum source, said valve means including a valve body with a molded plastic back portion and a molded plastic front portion, a gasket positioned between the back and front portions, and means connecting together the back and front portions and the gasket, said valve body back portion having an output channel molded in the front face of the valve body back portion for connecting air or vacuum to conduit means connecting with the pipet-supporting portion, said valve body front portion having an air valve post extending horizontally therefrom, a vacuum valve post extending horizontally therefrom, and a hose connector post extending horizontally therefrom to connect with a hose that extends to the pipet-supporting portion, an air input channel formed in the back of the valve body front portion and adapted to conduct air to the bore of the air valve post, and a vacuum input channel formed in the back of the valve body front portion and adapted to conduct vacuum to the bore of the vacuum valve post, said hose connector post having a bore adapted to conduct air or vacuum to the hose extending to the pipet-supporting portion, an air inlet pipe extending from the bottom of the valve body back portion and adapted to be connected to a hose connected to the air pressure source, and a horizontal air conduit extending toward the front portion of the valve body, and a vacuum inlet pipe extending from the bottom of the valve body back portion and adapted to be connected to a hose connected to the vacuum source, and a horizontal vacuum conduit extending toward the front portion of the valve body, said gasket being made of a resilient material and having a hole for passing inlet air from the valve body back portion air inlet pipe to the bore of the air valve post, a hole for passing vacuum from the body back portion vacuum inlet pipe to the bore of the vacuum valve post, a hole for passing air from the air valve post to the output channel, a hole for passing vacuum from the vacuum valve post to the output channel, and a seal bead contoured to contact the front face of the valve body back portion and surround the output channel.

* * * * *